US006154606A

United States Patent [19]

Shaw et al.

[11] Patent Number: 6,154,606

[45] Date of Patent: Nov. 28, 2000

[54] HEATER

[75] Inventors: Christian Guy Naylor Shaw, Kilkenny; James Gerard Tangney, Passage West, both of Ireland

[73] Assignees: Edward Duggan, Tramore; Michael Francis Carney, Waterford, both of Ireland

[21] Appl. No.: 09/314,935

[22] Filed: May 20, 1999

[30] Foreign Application Priority Data

May 20, 1998 [IE] Ireland ..... S980379
Sep. 25, 1998 [IE] Ireland ..... S980797

[51] Int. Cl.[7] ..... F24H 3/02

[52] U.S. Cl. ..... 392/360; 392/356; 392/410; 219/538

[58] Field of Search ..... 392/347, 350, 392/355, 356, 358, 359, 360, 363, 370, 407, 410; 219/523, 536, 538, 553

[56] References Cited

U.S. PATENT DOCUMENTS

| | | | |
|---|---|---|---|
| 2,521,654 | 9/1950 | Sandler | 392/360 |
| 2,904,317 | 9/1959 | Copeland et al. | 392/360 |
| 2,919,338 | 12/1959 | Covault et al. | 392/360 |
| 2,999,930 | 9/1961 | Burklin et al. | 392/360 |
| 3,165,625 | 1/1965 | Potter | 392/360 |
| 3,251,540 | 5/1966 | Kinsworthy | 392/360 |
| 4,103,146 | 7/1978 | Rampe | 392/360 |
| 4,117,308 | 9/1978 | Boggs et al. | 392/363 |
| 4,197,447 | 4/1980 | Jones | 392/356 |
| 4,362,090 | 12/1982 | Whiteley | 392/360 |
| 4,680,448 | 7/1987 | Fester | 392/356 |
| 4,694,142 | 9/1987 | Glucksman | 392/360 |
| 4,888,469 | 12/1989 | Hennuy et al. | 392/360 |
| 5,174,048 | 12/1992 | Shero | 392/360 |
| 5,345,533 | 9/1994 | Tarrant et al. | 392/356 |
| 5,619,612 | 4/1997 | Glucksman et al. | 392/360 |
| 5,652,826 | 7/1997 | Mills | 392/360 |

*Primary Examiner*—Teresa Walberg
*Assistant Examiner*—Fadi H. Dahbour
*Attorney, Agent, or Firm*—Jacobson, Price, Holman & Stern, PLLC

[57] ABSTRACT

A radiant heater mounting heating elements in a sealed housing with a ceramic heat transmitting wall. A fan is mounted in the housing to cool the heating elements and in practice provide additional heat. There are also vent assemblies which prevent water such as rainwater or even water from, for example, a hose entering into the heater and causing failure.

16 Claims, 8 Drawing Sheets

HEATER

BACKGROUND OF THE INVENTION

1. Field of the Invention

The present invention relates to a heater of the type comprising a housing having a heat transmitting wall, main end walls and main body walls, the heater element being mounted in the housing behind the heat transmitting wall and air inlet and outlet holes.

2. Background Information

Generally speaking these are mains powered heaters. One of the problems is they have a large number of inlets and outlets to allow them to keep the heating element cool. This makes them susceptible to water ingress. The housing can get extremely hot during use and can be a hazard if somebody touches it. They have been particularly useful for indoor heating such as, for example, in large arenas.

Such heaters are often called radiant heaters to distinguish them from heaters which work on the principle of heat convection. The heat rays are partially absorbed and partially reflected by the surfaces they impinge on and are thus very useful for instant, heat and for heating large areas with high air movement such as assembly halls, churches or the outdoors. The most useful form of such heater is one utilising a quartz element operating at temperatures in excess of 2000° C. The present invention is particularly directed to such radiant heaters, simply referred to as heaters.

Mains powered electrical heaters are the preferred heating unit for many uses and particularly for indoor use, however, heretofore they have not been particularly successful for outdoor use because they have been unable to withstand adverse ambient conditions. Some of the major accidents occur outdoors when high voltage electrical units are used. For this reason, it is now almost essential on all building sites, for example, to have low voltage hand tools and the like. However, such low voltage units are not suitable generally for heating units. Thus, there is a need for a mains powered electrical heater which can use the full voltage of the mains such as 220 to 240 volts without the need for step down transformers and the like.

Such a mains powered electrical heater must be capable of withstanding not only ordinary adverse ambient conditions but also man induced adverse conditions. The principal problem is undoubtedly the ingress of moisture into such heaters. Obviously, this can be caused by nature such as by driving rain and the like, but equally can be caused by some form of human intervention such as the use directly of hose pipes and the like directed onto the heater, burst pipes and so on.

Further in many horticultural and agricultural use such as the rearing of animals, it is necessary to provide conditions of considerable humidity and at the same time provide heat. Often these, particularly with animal houses, have to be washed down regularly and personnel uses hoses and the like to wash down the buildings and inevitably accidents occur.

OBJECTS

The present invention is directed towards providing an improved construction of a mains powered electrical heater so it can be used outdoors and indoors where there is a likelihood of the heater being subjected water.

SUMMARY OF THE INVENTION

According to the invention there is provided a heater of the type comprising a housing having a heat transmitting wall, main end walls and main body walls, a heating element in the housing behind the heat transmitting wall and air inlet and outlet holes characterised in that the housing is an enclosed unit and each air inlet and outlet comprises a vent assembly, communicating with the interior of the housing through a housing inlet, the vent assembly having an external aperture and shrouding means having a covering surface spaced-apart from and extending across the external aperture and liquid drain off means between the covering surface and the external aperture and a fan for feeding air through the heater. The advantage of this is that use of a fan ensures the heater will remain cool at all times, such that if somebody brushes against the heater or touches the heater they will not be burnt. Secondly, the use of the fan ensures sufficient heating and because of the fan any heat provided is in fact driven out to where it can be used and does not simply go to heat the actual heater itself and the surrounding wall on which it is usually mounted. Further by having the vent assemblies the hazard from the ingress of water is greatly reduced.

In one embodiment of the invention the vent assembly comprises a box-like casing having an open mouth for covering the housing inlet and in which the casing has a hole forming the external aperture and in which portion of the housing projects across the aperture to form the covering surface. By using the actual housing itself and not having to provide anything else, the advantage is that the casing itself forms the protection and this leads to a relatively inexpensive heater.

Ideally a louvred plate is mounted in the external aperture. The advantage of the louvred plate it that it can be angled such as to ensure that when water impinges on the aperture that the louvred plate prevents it going directly through into the casing.

In a further embodiment of the invention there is provided a pair of spaced-apart plates, namely, an inner plate and an outer plate, are mounted in the casing, the inner plate closing the casing and having a hole forming the external aperture and the outer plate forming the shrouding means and having a hole offset from the external aperture and a liquid drain-off providing by a hole in the casing between the plates. This is a very simple way of achieving the present invention and in this latter embodiments the holes mount louvered plates.

In one preferred embodiment of the invention the vent assembly comprises a box-like casing having an open mouth for covering the housing inlet and in which the casing has a pair of spaced-apart plates, namely, an inner plate and an outer plate, the inner plate closing the casing and having a hole forming the external aperture and the outer plate forming the shrouding means and having a hole offset from the external aperture and a liquid drain-off provided by a hole in the casing between the plates. This is a relatively simple construction and is particular effective.

Further in one particular embodiment of the invention, the heating element is mounted between spaced-apart support plates, each in turn spaced-apart from the adjacent main end wall and from some of the main body walls and the heating transmitting wall and in which there is a hole in each support plate to direct air across the heating element. By having this arrangement, it ensures that the heating element is cooled rapidly as are the surrounding pieces of the structure, including as its usually used, any parabolic reflective elements or the like.

Ideally the casing is integral with the housing.

In one embodiment of the invention there is additionally provided a mounting bracket comprising a wall engaging support and a pair of heater supports each converging from opposite ends of the wall engaging support in triangular configuration, the angle subtended by the wall support with each heater support being different. This allows the heater to be mounted at different angles which ensures that the vent assembly is well protected.

Ideally the angles are approximately 25° and 45°. These have been found to be particularly suitable.

Preferably the heat transmitting wall is manufactured from a clear ceramics material. This has considerable advantages in that it will not warp or suffer any deterioration during use.

Ideally a thermal cut-out is provided to switch off the heater when the temperature within the housing exceeds a preset temperature. This ensures that the heater will not overheat and ideally the preset temperature is of the order of 120° C. Thus, for example, if the fan fails the heater will cut out. Further it is envisaged that if the heater overheats and the fan has not failed, the fan can continue to operate until the temperature drops below an acceptable temperature.

BRIEF DESCRIPTION OF THE DRAWINGS

The invention will be more clearly understood from the following description of some embodiments thereof, given by way of example only described with reference to the accompanying drawings in which.

DESCRIPTION OF THE PREFERRED EMBODIMENTS

Figure 1:
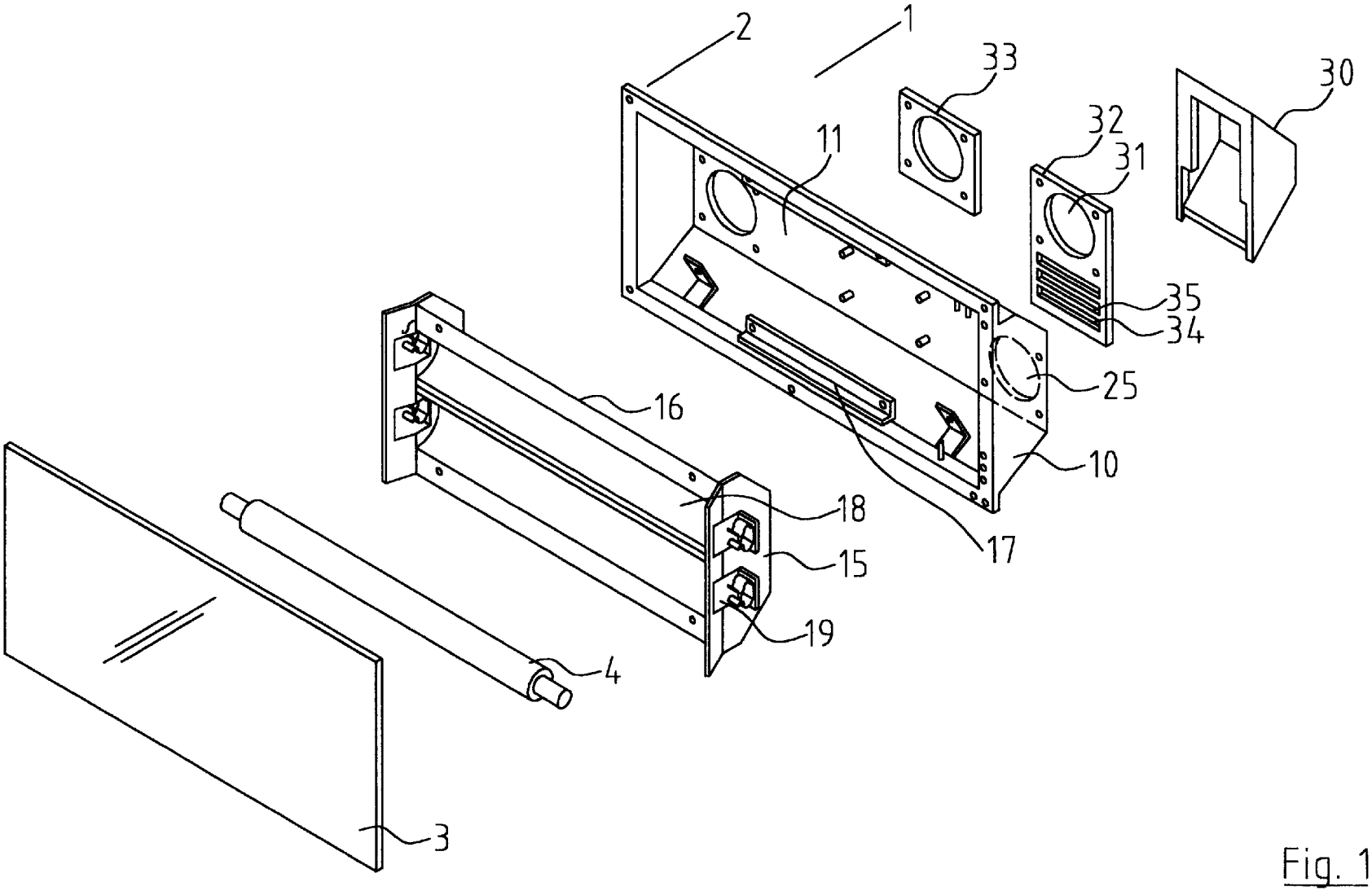
FIG. 1 is a perspective part exploded view from the front of portion of a heater according to the invention.

Referring to the drawings and initially to FIGS. 1 to 9 thereof, there is illustrated a mains powered radiant heater indicated generally by the reference numeral 1 comprising a sealed housing 2 having a heat transmitting wall 3 manufactured from a clear ceramics material such as sold under the Trade Mark KERALITE. A heating element 4 is mounted behind the heat transmitting wall 3 and there an air inlet provided by a vent assembly 5 and an air outlet 6 provided by a similar vent assembly, only shown from the rear. A fan 7 is mounted in the housing 2.

The housing 2 comprises additionally main end walls 10 and main body walls 11 on which are support plates 15 carrying the heating element 4. The support plates 15 are bridged by a pair of mounting plates 16 which engage angles 17 on the main body wall 11. The mounting plates 16 also carry two parabolic reflectors 18. Electrical connection are not shown. It will be noted that there are provided two large holes 19 on each mounting plate 16 to allow the direction of air across the heating element 4. These holes 19 act as heating element vents. There is also, it will be noted, gaps 20 and 21 adjacent the front and rear, respectively, of the support plate 16 to also provide air ducts and hence cool air across the housing surfaces. A pair of housing inlets 25 are provided on either side of the mounting plates 16 in one case behind the fan 7 and on the other the side remote from it. The vent assembly 5 is mounted on the housing 2 to cover each housing inlet 5.

The vent assembly 5 comprises a box-like casing 30 having an open mouth 31 for covering the housing inlet 25 and it will be noted from the drawing that the open mouth 31 is provided on a plate 32 and there is also included a mounting gasket 33. In this embodiment the plate 32 has a hole forming an external aperture for the heater, which external hole 34 mounts a number of louvres 35. In this embodiment the bottom of the external aperture 34 provides a drain-off hole for the casing 30.

Figure 4:
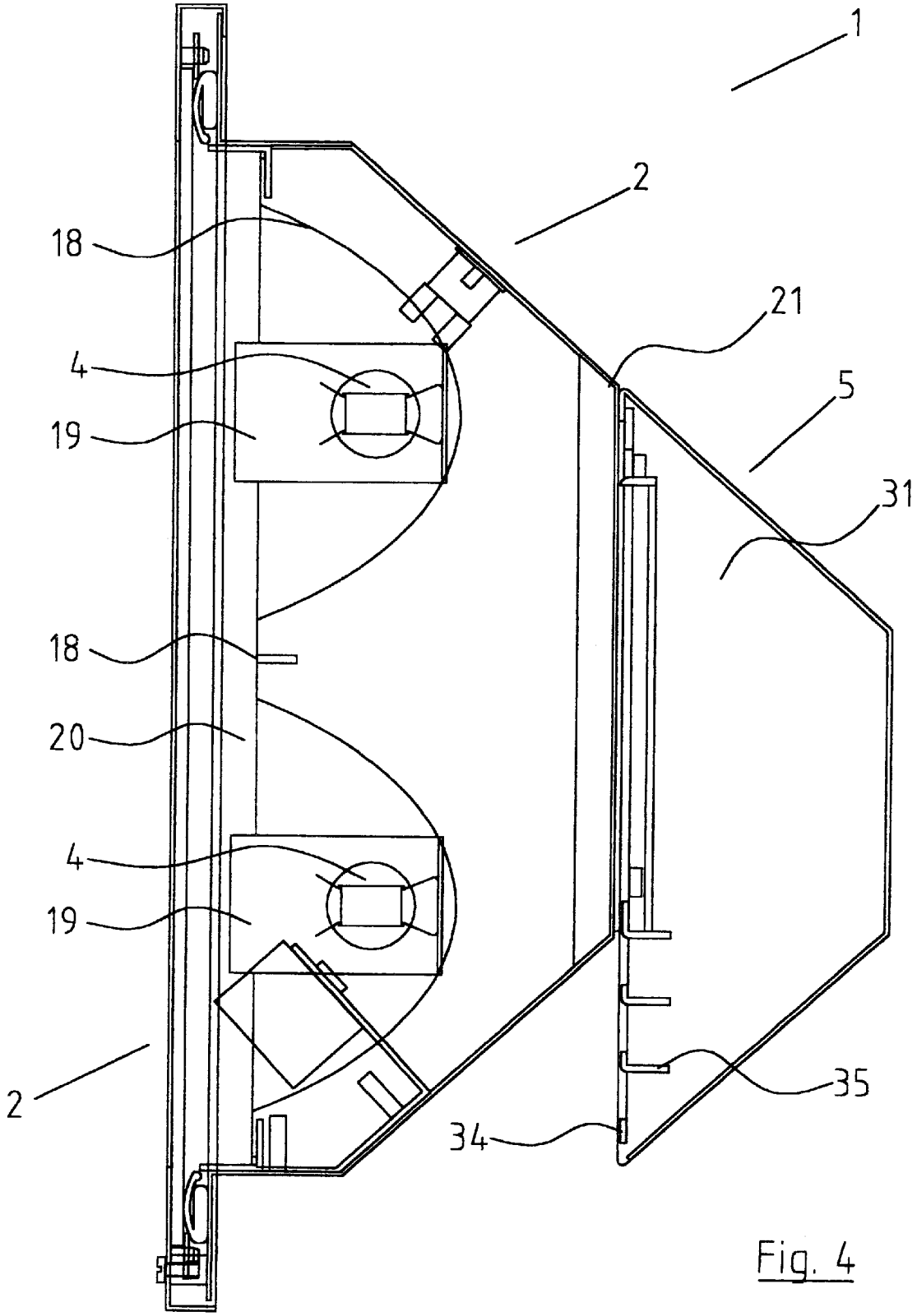
FIG. 4 is a schematic sectional view of the heater.
Figure 6:
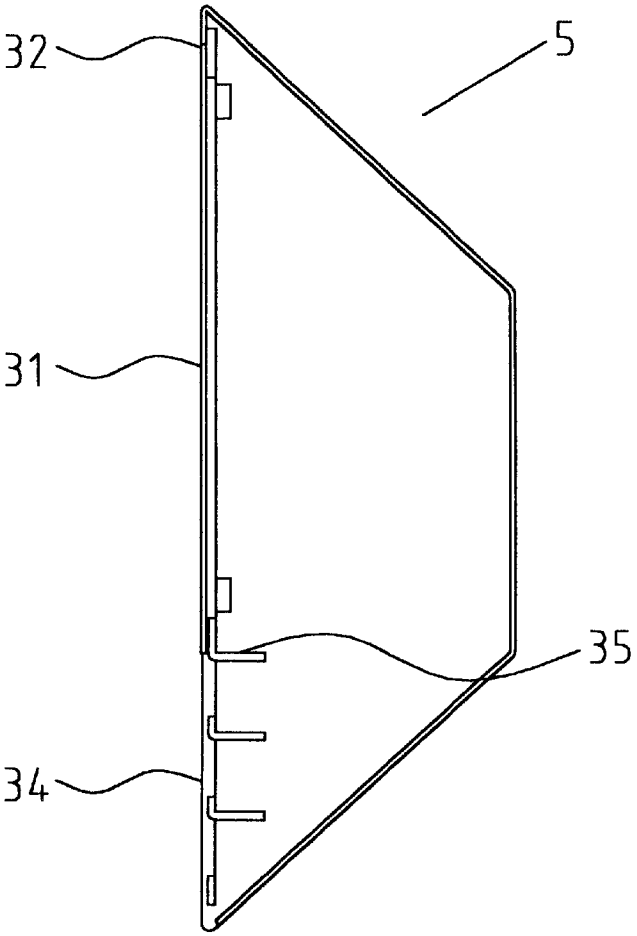
FIG. 6 is a side sectional view of the portion of the heater illustrated in FIG. 5.
Figure 5:
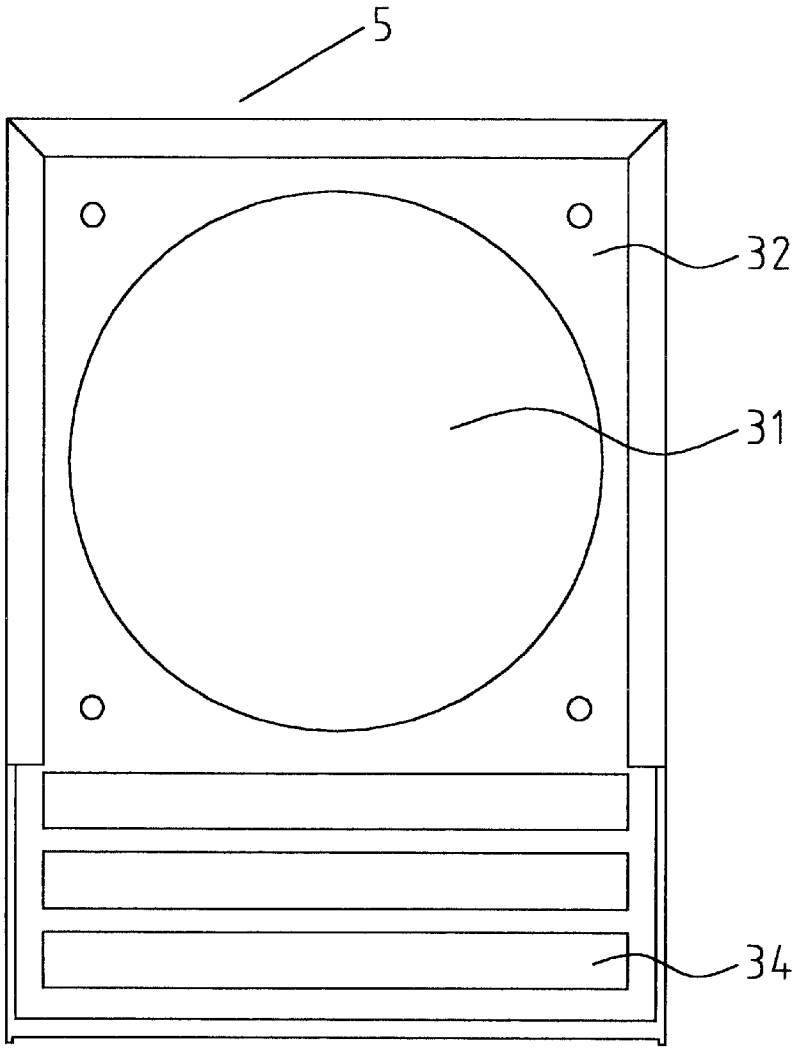
FIG. 5 is a front view of portion of the heater.
Figure 8:
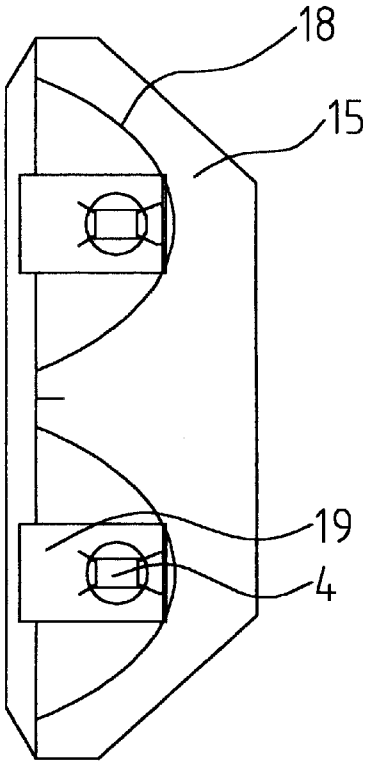
FIG. 8 is a side sectional view of the portion of the heater illustrated in FIG. 5.
Figure 7:
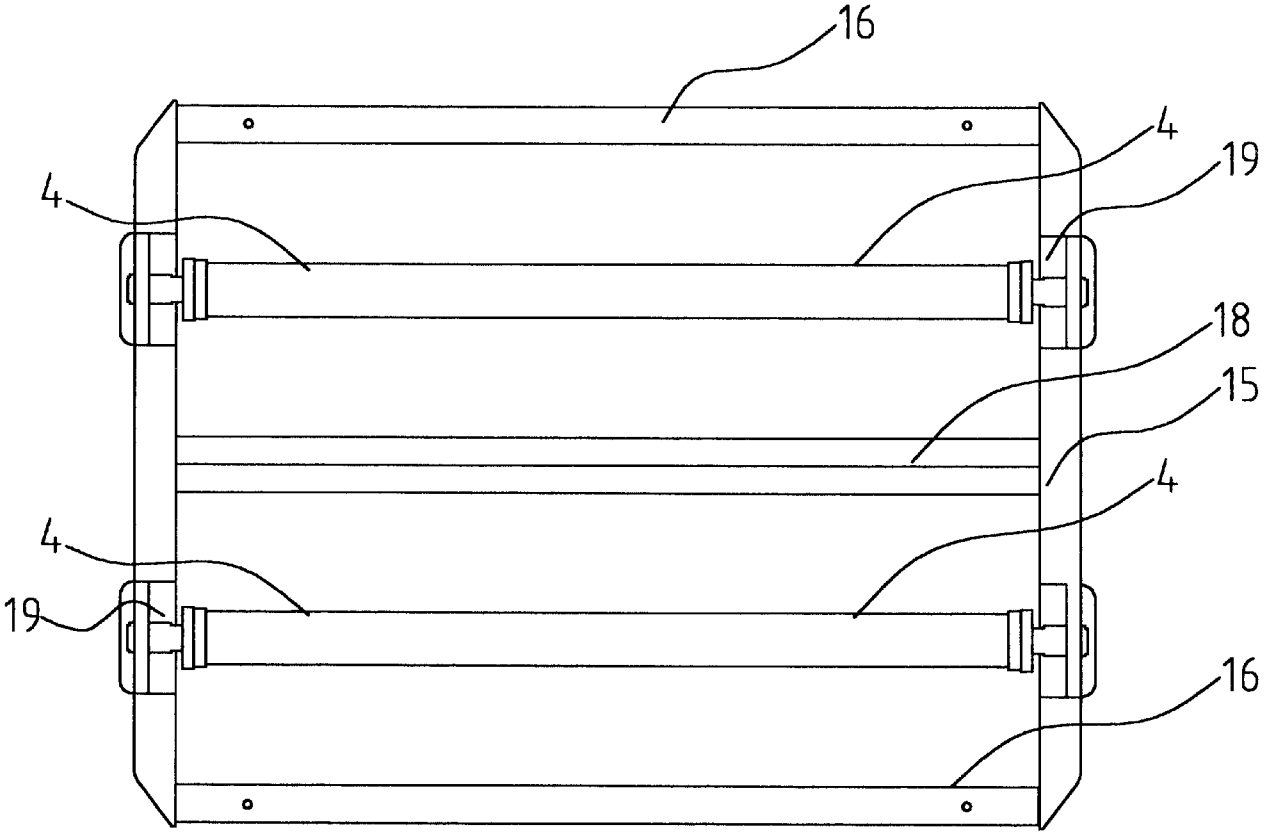
FIG. 7 is a front view of another portion of the heater.

As can be seen clearly from FIG. 4 the housing 2 projects across the external aperture 34 to form a covering surface for the aperture.

Figure 2:
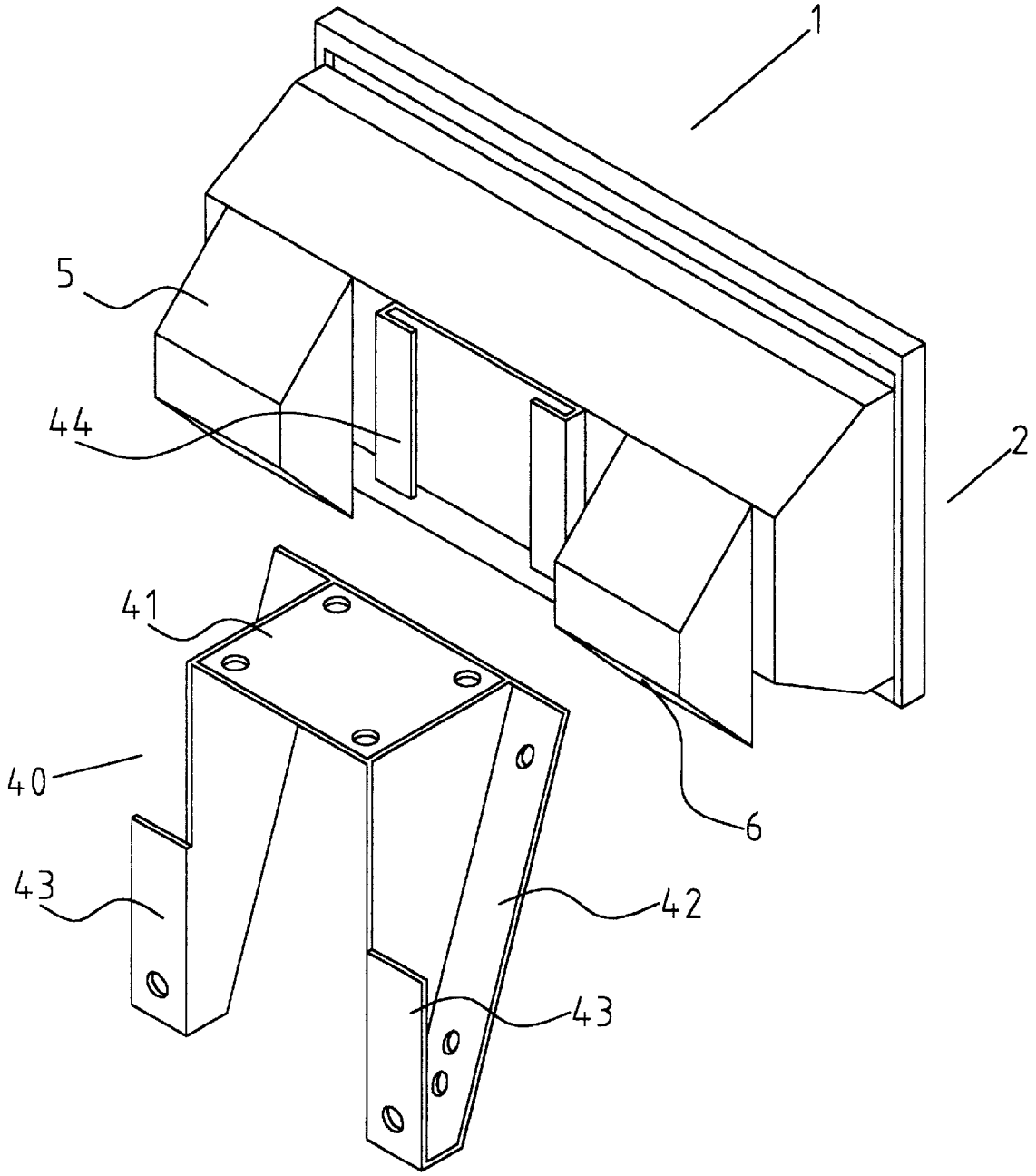
FIG. 2 is an exploded part rear view of the heater.
Figure 3:
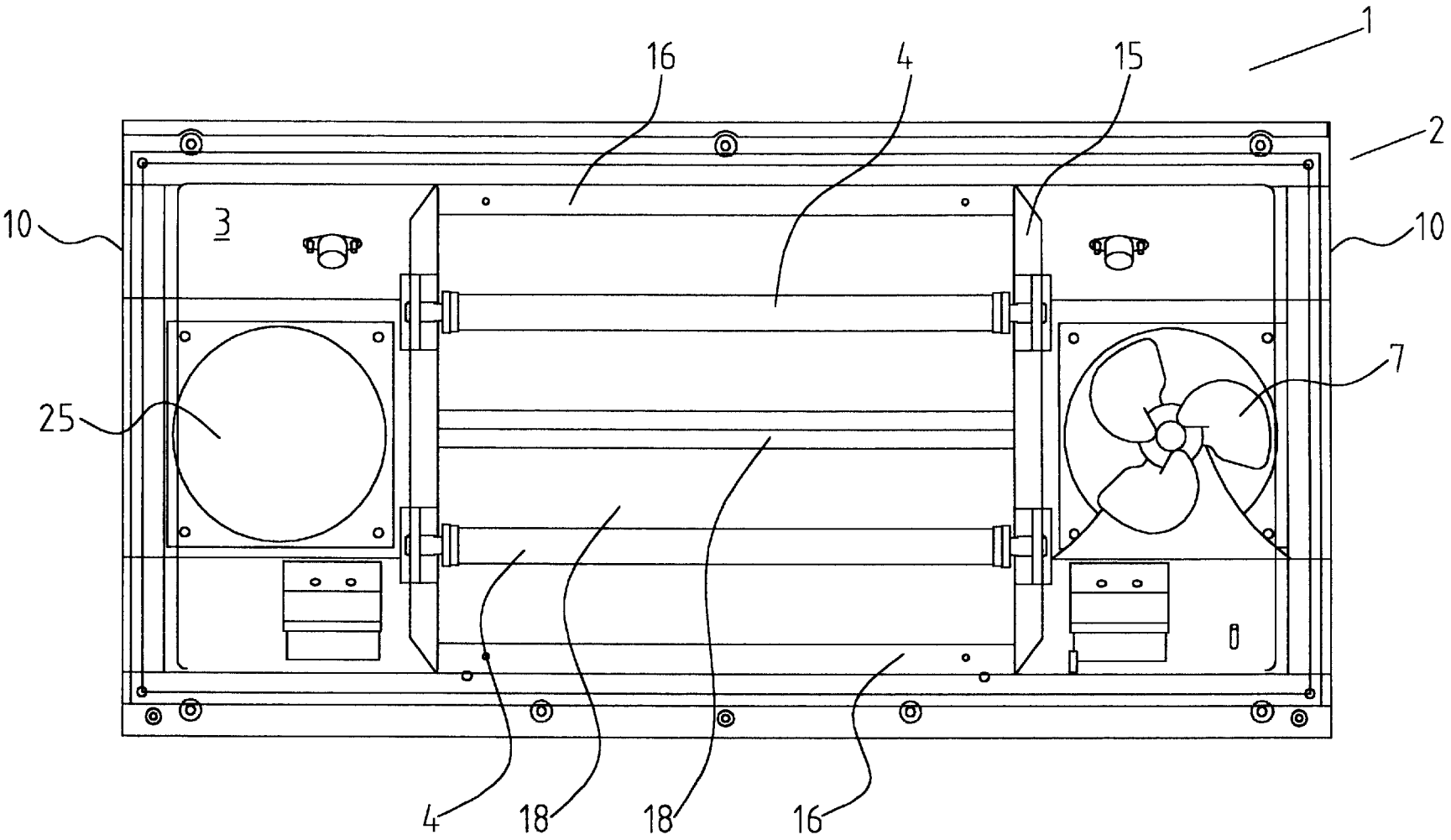
FIG. 3 is a front view of the heater.

Referring now specifically to FIG. 2 there is shown a mounting bracket indicated generally by the reference numeral 40. The mounting bracket 40 comprises a wall engaging support plate 41 formed from the one sheet of material which is also bent to form a pair of side plates out of which are formed heater engaging male supports 42 and 43 which slot inside female angles 44 mounted on the main body wall 11 at the rear of the housing 2.

Figure 9B:
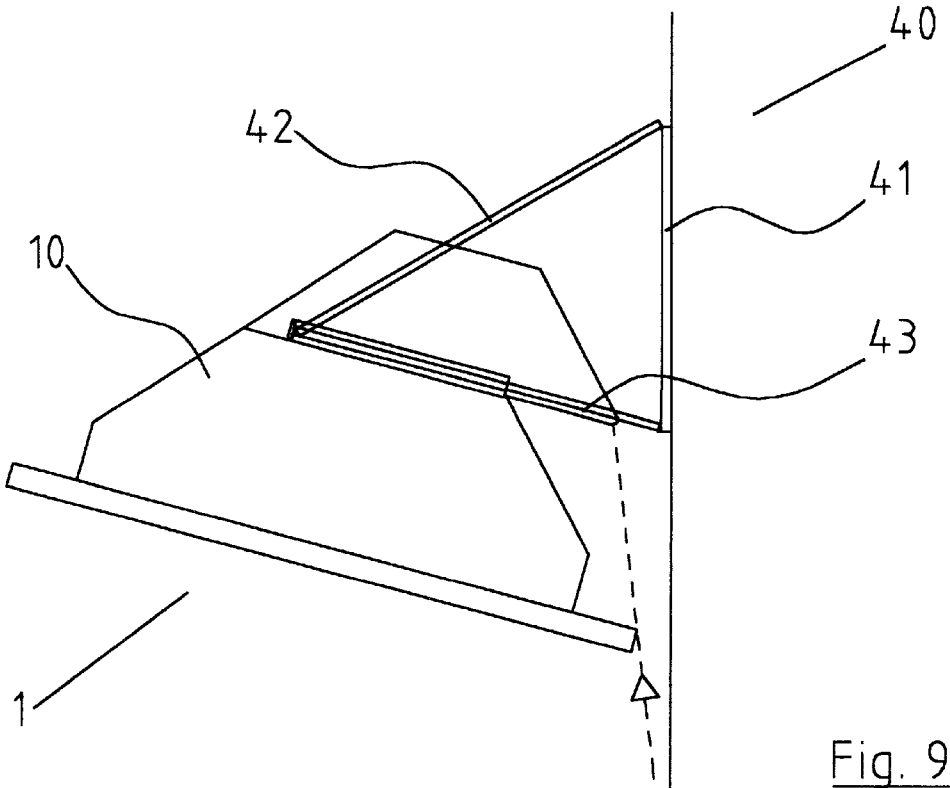
FIGS. 9(*a*) and (*b*) illustrate the heater mounted on the wall.
Figure 9A:
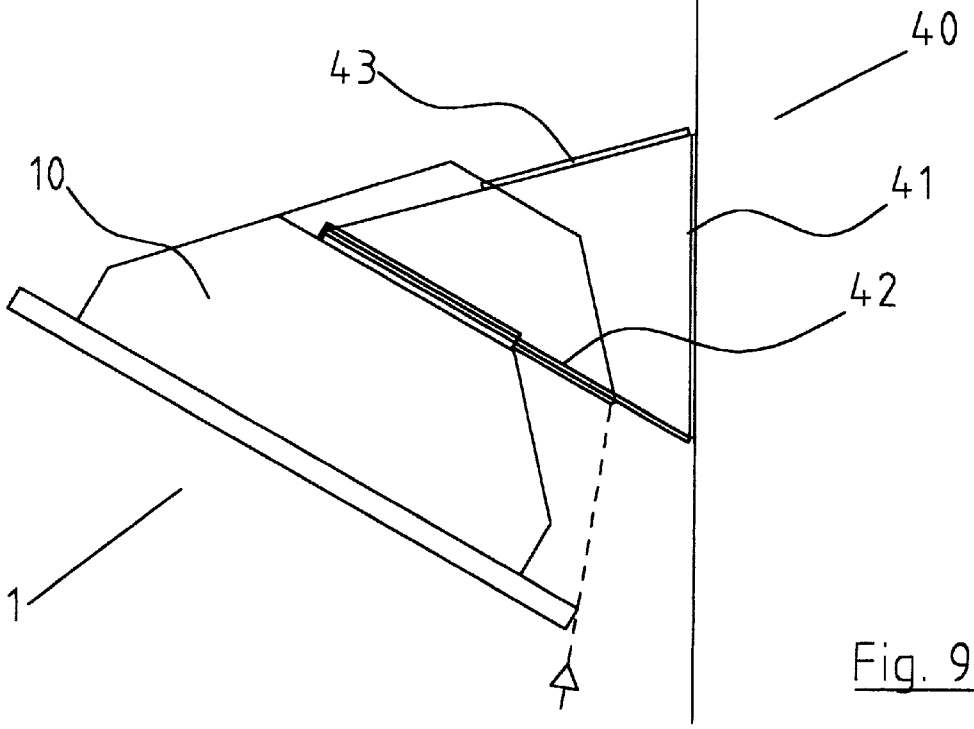

FIGS. 9(*a*) and (*b*) show clearly how the different orientation of the mounting bracket 40 changes the angle of the heater relative to the wall. For example, in the particular configuration shown in FIG. 9(*b*) only water directed almost vertically upwards from a hose would in fact impinge directly against the external aperture 34 even then would bear against the louvres so that it would not directly go into the casing. In the embodiment shown in FIG. 9(*a*) obviously there is a greater arc in which water can be delivered into the housing. It is envisaged that one of the male supports 42 or 43 could be used to mount the bracket 40 against the wall and provide further flexibility.

It has been found that very quickly, once the heater has started, that there is instantaneous heat and as the fan cools the heater, the housing and all the surrounds of the heater remain cool and hence there is no heat loss, nor indeed is there any likelihood of damage if somebody touches the heater.

Further it has been found from tests that when subjected to quite severe hazardous conditions that the ingress of water into the heater was minimal.

Figure 10:
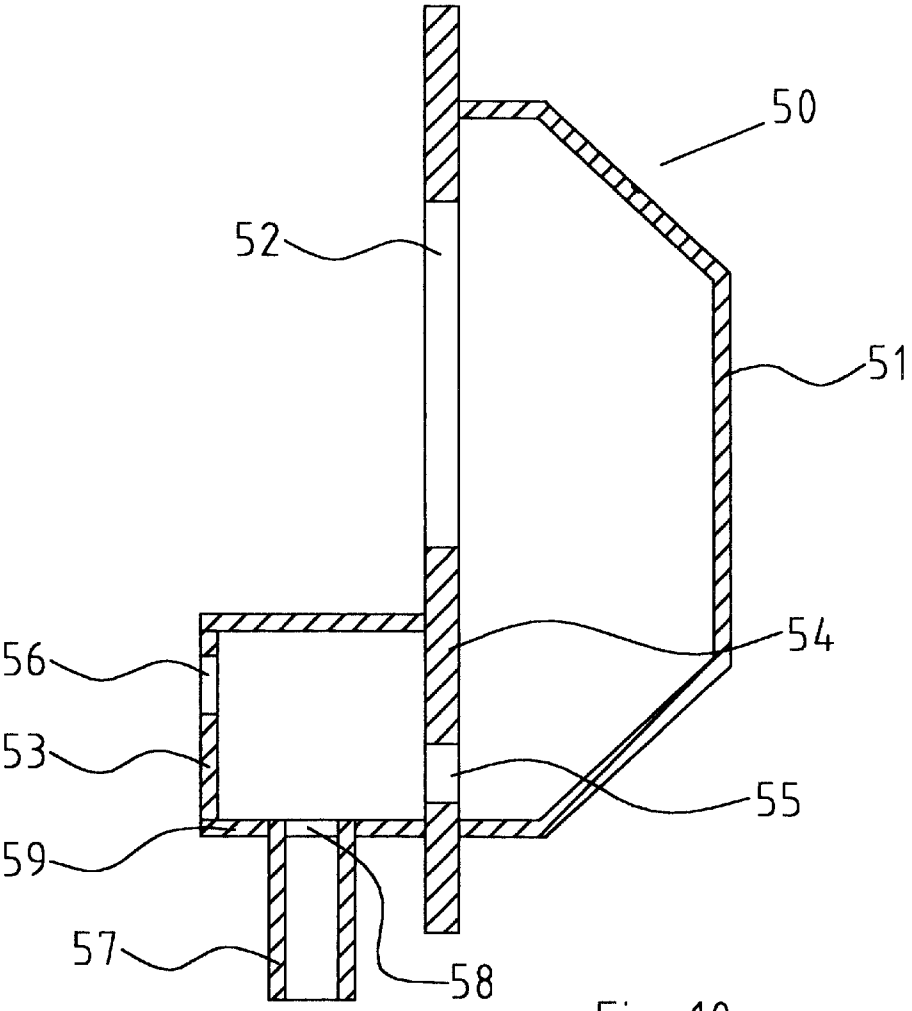
FIG. 10 is a sectional view an alternative construction of a casing such as illustrated in FIGS. 5 and 6.

Referring to FIG. 10 there is illustrated an alternate construction of box-like casing of a vent assembly indicated generally by the reference numeral 50 having a box-like casing 51 having an open mouth 52 for covering the housing inlet. The vent assembly 50 comprises a pair of spaced-apart plates, namely an outer plate 53 and an inner plate 54. The inner plate 54 closes the casing 51 and has a hole 55 forming the external aperture. The outer plate 53 forms shrouding means and has a hole 56 offset from the external aperture 55 and a liquid drain-off provided by a pipe 57 from a hole 58 in a plate 59 forming an extension of the casing.

Figure 11:
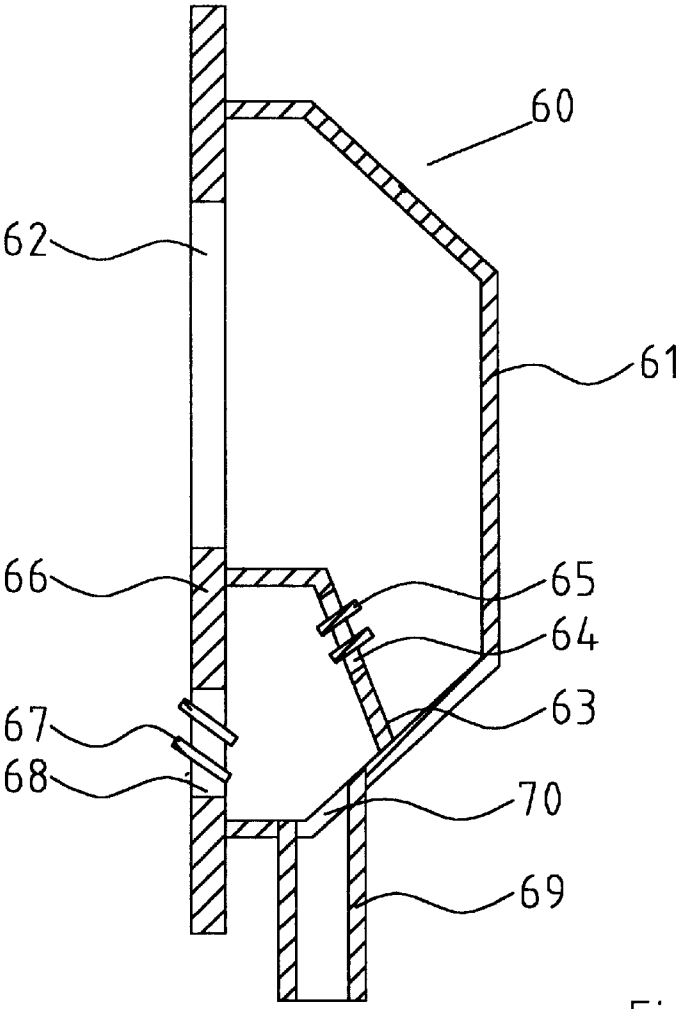
FIG. 11 is another alternative construction of a casing similar to that illustrated in FIGS. 5 and 6.

Referring to FIG. 11 there is illustrated a still further construction of vent assembly indicated generally by the reference numeral 60 having a box-like casing 61 and having an open mouth 62 for connection to the housing inlet, which vent assembly 60 again includes an inner plate 63 having apertures 64 including louvres 65 and an outer plate 66 having a hole 67 mounting louvres 68. A drain-off pipe 69 is mounted between the inner plate 64 and the outer plate 66. Again it will be seen how any water passing through the louvres 67 will not pass through the louvres 65 and thus the interior of the casing 61 will remain relatively dry. Any excess water is delivered out the pipe 69.

It is envisaged that many other means for providing a tortuous passageway for water may be provided.

It is also envisaged that while in the embodiment described above, there is provided a vent assembly with a separate casing, but this may not necessary be required in every instance.

Also it is envisaged that many other forms of mounting brackets or adjustable bracket may be used.

The heat transmitting wall is manufactured from any suitable ceramics material, but it will be appreciated that many other materials may be used, while that sold under the Trade Mark KERALITE has been found to be particularly useful.

Ideally a thermal cut-out of conventional construction is provided to switch off the heater when the temperature within the housing exceeds a preset temperature, ideally this preset temperature is of the order of 120° C.

Further it is envisaged that other controls could be provided such as, for example, moisture detecting means whereby if during switch-off moisture enters the heater, the heater will not switch on until the water has been removed.

In the specification the terms "comprise, comprises, comprised and comprising" or any variation thereof and the terms "include, includes, included and including" or any variation thereof are considered to be totally interchangeable and they should all be afforded the widest possible interpretation and vice versa.

The invention is not limited to the embodiment hereinbefore described, but may be varied in both construction and detail.

What is claimed is:

1. A radiant heater comprising:

a sealed housing comprising a heat transmitting wall, two spaced apart main end walls and main body walls;

a heating element mounted in the housing behind the heat transmitting wall;

at least two spaced apart vent assemblies, each vent assembly communicating between the exterior and interior of the housing through a housing inlet;

an air access for each vent assembly provided by an external aperture;

a shrouding means for each of said vent assemblies having a covering surface spaced-apart from and extending across the external aperture;

a liquid drain-off means between each covering surface and the external aperture; and a fan mounted in the housing for feeding air through the heater.

2. A radiant heater as claimed in claim 1, in which the vent assembly comprises a box-like casing having an open mouth for covering the housing inlet and in which the casing has a hole forming the external aperture and in which portion of the housing projects across the aperture to form the covering surface.

3. A radiant heater as claimed in claim 2, in which a louvered plate is mounted in the external aperture.

4. A radiant heater as claimed in claim 2, in which a pair of spaced-apart plates, namely, an inner plate an outer plate, are mounted in the casing, the inner plate closing the casing and having a hole forming the external aperture and the outer plate forming additional shrouding means and having a hole offset from the external aperture and a liquid drain-off providing by a hole in the casing between the plates.

5. A radiant heater as claimed in claim 2, in which a pair of spaced-apart plates, namely, an inner plate and an outer plate, are mounted in the casing, the inner plate closing the casing and having a hole forming the external aperture and the outer plate forming additional shrouding means and having a hole offset from the external aperture and a liquid drain-off providing by a hole in the casing between the plates and in which the holes mount louvered plates.

6. A radiant heater as claimed in claim 2, in which the heating element is mounted between spaced-apart support plates, each in turn spaced-apart from the adjacent main end wall and from some of the main body walls and heating transmitting wall and a heating element vent formed by a hole in each support plate to direct air across the heating element.

7. A radiant heater as claimed in claim 2, in which a louvered plate is mounted in the external aperture and in which the heating element is mounted between spaced-apart support plates, each in turn spaced-apart from the adjacent main end wall and from some of the main body walls and heat transmitting wall and a heating element vent formed by a hole in each support plate to direct air across the heating element.

8. A radiant heater as claimed in claim 2, in which a pair of spaced-apart plates, namely, an inner plate and an outer plate, are mounted in the casing, the inner plate closing the casing and having a hole forming the external aperture and the outer plate forming additional shrouding means and having a hole offset from the external aperture and a liquid drain-off providing by a hole in the casing between the plates and in which the heating element is mounted between spaced-apart support plates, each in turn spaced-apart from the adjacent main end wall and from some of the main body walls and heat transmitting wall and a heating element vent formed by a hole in each support plate to direct air across the heating element.

9. A radiant heater as claimed in claim 2, in which the casing is integral with the housing.

10. A radiant heater as claimed in claim 1, in which the vent assembly comprises a box-like casing having an open mouth for covering the housing inlet and in which the casing has a pair of spaced-apart plates, namely, an inner plate and an outer plate, the inner plate closing the casing and having a hole forming the external aperture and the outer plate forming the shrouding means and having a hole offset from the external aperture and a liquid drain-off provided by a hole in the casing between the plates.

11. A radiant heater as claimed in claim 10, in which the holes mount louvered plates.

12. A radiant heater as claimed in claim 10, in which the heating element is mounted between spaced-apart support plates, each in turn spaced-apart from the adjacent main end wall and from some of the main body walls and heating transmitting wall and a heating element vent formed by a hole in each support plate to direct air across the heating element.

13. A radiant heater as claimed in claim 10, in which the heating element is mounted between spaced-apart support plates, each in turn spaced-apart from the adjacent main end wall and from some of the main body walls and heating transmitting wall and a heating element vent formed by a hole in each support plate to direct air across the heating element and in which the holes mount louvered plates.

14. A radiant heater as claimed in claim 10, in which the casing is integral with the housing.

15. A radiant heater comprising:

a sealed housing comprising a heat transmitting wall, two spaced apart main end walls and main body walls;

a heating element mounted in the housing behind the heat transmitting wall;

at least two spaced apart vent assemblies, each vent assembly communicating between the exterior and interior of the housing through a housing inlet;

an air access for each vent assembly provided by an external aperture;

a shrouding means for each of said vent assemblies having a covering surface spaced-apart from and extending across the external aperture;

a liquid drain-off means between each covering surface and the external aperture; and a mounting bracket comprising a wall engaging support and a pair of heater supports each converging from opposite ends of the wall engaging support in triangular configuration, the angle subtended by the wall support with each heater support being different.

16. A radiant heater as claimed in claim 15, in which the vent assembly comprises a box-like casing having an open mouth for covering the housing inlet and in which the casing has a hole forming the external aperture and in which portion of the housing projects across the aperture to form the covering surface.

* * * * *